US010429148B2

(12) United States Patent
Jacobson et al.

(10) Patent No.: US 10,429,148 B2
(45) Date of Patent: Oct. 1, 2019

(54) FIREARM CLEANING MAT

(71) Applicant: Revo Brand Group, LLC, Plymouth, MN (US)

(72) Inventors: Ryan Jacobson, Minneapolis, MN (US); James Hofman, Eden Prairie, MN (US)

(73) Assignee: Revo Brand Group, LLC, Plymouth, MN (US)

( * ) Notice: Subject to any disclaimer, the term of this patent is extended or adjusted under 35 U.S.C. 154(b) by 124 days.

(21) Appl. No.: 15/644,468

(22) Filed: Jul. 7, 2017

(65) Prior Publication Data

US 2018/0010877 A1 Jan. 11, 2018

Related U.S. Application Data

(60) Provisional application No. 62/360,701, filed on Jul. 11, 2016.

(51) Int. Cl.

| | |
|---|---|
| ***F41A 29/00*** | (2006.01) |
| ***B08B 13/00*** | (2006.01) |
| ***A47B 88/919*** | (2017.01) |
| ***B08B 17/02*** | (2006.01) |
| *A47B 96/18* | (2006.01) |

(52) U.S. Cl.

CPC ..... *F41A 29/00* (2013.01); *A47B 88/919* (2017.01); *B08B 13/00* (2013.01); *B08B 17/025* (2013.01); *A47B 96/18* (2013.01); *A47B 2200/0084* (2013.01)

(58) Field of Classification Search

CPC ..... F41A 29/00

USPC ..... 428/99

See application file for complete search history.

(56) References Cited

U.S. PATENT DOCUMENTS

| | | | | |
|---|---|---|---|---|
| 5,785,219 | A * | 7/1998 | Kraft | A45F 4/02 2/66 |
| D716,547 | S * | 11/2014 | Pennington | D3/262 |
| 2016/0059066 | A1 * | 3/2016 | Willis | A63B 21/4037 5/417 |

OTHER PUBLICATIONS

"Napier Universal Air Gun Rifle Cleaning Mat Surface Protector Tool Kit Roll," eBay, http://www.ebay.co.uk/itm/Napier-Universal-Air-Gun-Rifle-Cleaning-Mat-Surface-Protector-Tool-Kit-Roll-/252577750482, Jun. 7, 2017, 6 pp.

"21-Piece Universal Handgun Cleaning Kit with Integrated TekMat Cleaning Mat," TekMat Gun Accessories, http://tekmat.com/gun-cleaning-kits, Jun. 7, 2017, 2 pp.

* cited by examiner

*Primary Examiner* — Brent T O'Hern

(74) *Attorney, Agent, or Firm* — Grumbles Law PLLC; Brittany Nanzig; Stephen Wolf

(57) ABSTRACT

A firearm cleaning mat having an oil and/or solvent repellent surface and a small parts storage tray, the mat and tray being used during adjustment and maintenance of firearms. The oil and/or solvent repellent surface protects the firearm and the surface it is placed on from scratches and dents. The small parts storage tray is used to contain small parts and prevent them from being lost during firearm cleaning. A magnet is included in the small parts tray to retain small metal parts in the tray.

16 Claims, 6 Drawing Sheets

FIREARM CLEANING MAT

CROSS-REFERENCE TO RELATED APPLICATION

This application claims the benefit of U.S. Provisional Application No. 62/360,701 filed Jul. 11, 2016 and titled FIREARM CLEANING MAT.

FIELD OF THE INVENTION

This disclosure relates to a mat used for firearm cleaning. More specifically, it relates to an oil and/or solvent repellent mat having a small parts storage tray, the mat and tray being used during adjustment and maintenance of firearms.

BACKGROUND OF THE INVENTION

After use and throughout their lives, firearms are affected primarily by carbon build-up. However, they are also affected by moisture, rust, and gunpowder residue. Therefore, firearms often need to be cleaned so they do not rust and decay. To accomplish this, individuals must take a firearm apart and clean each of the several firearm components. However, many of these components are small and can, therefore, be easily lost during cleaning. To date, some individuals will place the firearm on a designated mat in order to prevent the pieces from being scratched and to keep the pieces in a designated area. However, the small pieces, such as screws, pins, and washers can still easily be misplaced. Therefore, a firearm cleaning mat is needed that can protect the pieces from being scratched, that can prevent small pieces from being lost during cleaning, and that can protect a table top surface from being damaged during cleaning.

SUMMARY OF THE INVENTION

The present disclosure relates to a firearm cleaning mat having a work surface and a small parts storage tray. The work surface protects the firearm and the surface it is placed on from scratches and dents. In one embodiment, the work surface is oil and/or solvent repellent. The small parts storage tray is used to contain small parts and prevent them from being lost during firearm cleaning. A magnet is included in the small parts tray to retain small metal parts in the tray.

DETAILED DESCRIPTION

Figure 1:
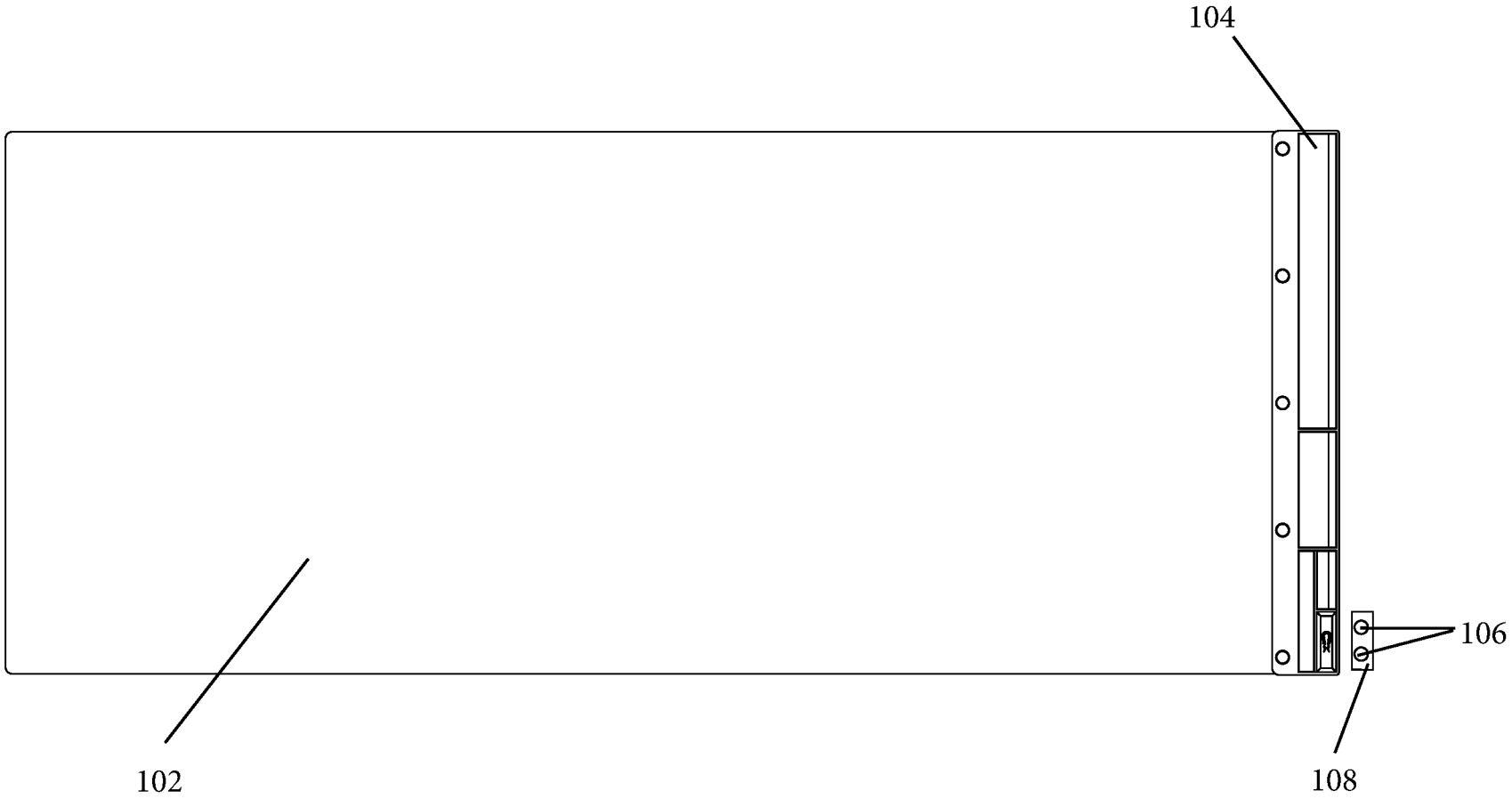
FIG. 1 is a top plan view of a firearm cleaning mat according to one embodiment of the present invention.

The present disclosure relates to a firearm cleaning mat that is used to protect a firearm from scratches and dents when it is being cleaned and to prevent small parts from being lost when the firearm is disassembled for cleaning. Various embodiments of the firearm cleaning mat will be described in detail with reference to the drawings, wherein like reference numerals represent like parts and assemblies throughout the several views. Reference to various embodiments does not limit the scope of the firearm cleaning mat disclosed herein. Additionally, any examples set forth in this specification are not intended to be limiting and merely set forth some of the many possible embodiments for the firearm cleaning mat. It is understood that various omissions and substitutions of equivalents are contemplated as circumstances may suggest or render expedient, but these are intended to cover applications or embodiments without departing from the spirit or scope of the disclosure. Also, it is to be understood that the phraseology and terminology used herein are for the purpose of description and should not be regarded as limiting.

Some embodiments of the firearm cleaning mat disclosed herein include features that are best suited for firearms maintenance and adjustment. The various components of the firearm cleaning mat help protect the surfaces of firearms pieces and components when the firearm is disassembled and allow users to store small pieces for safekeeping during disassembly.

Figure 2:
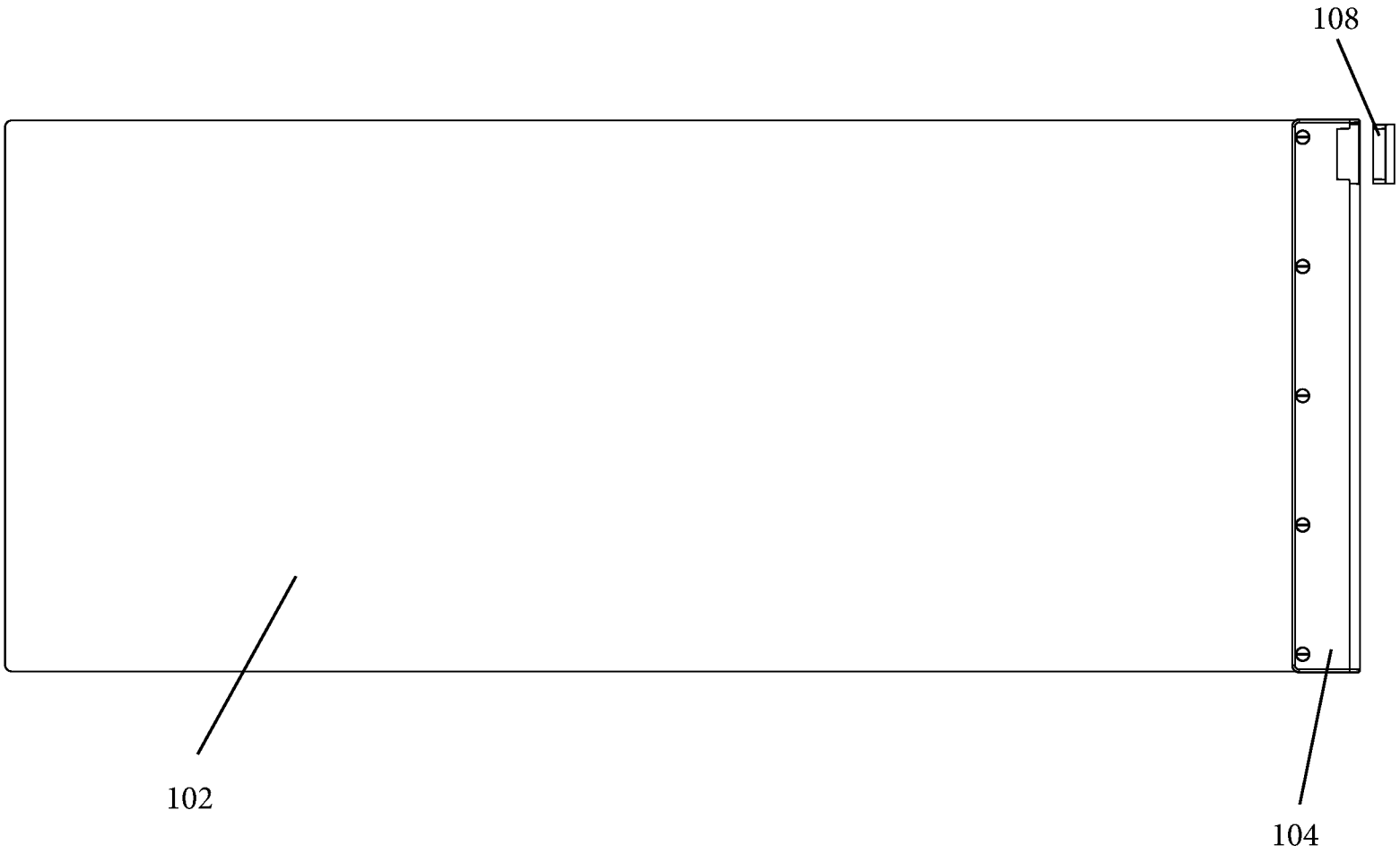
FIG. 2 is a bottom plan view of the firearm cleaning mat of FIG. 1.
Figure 3:
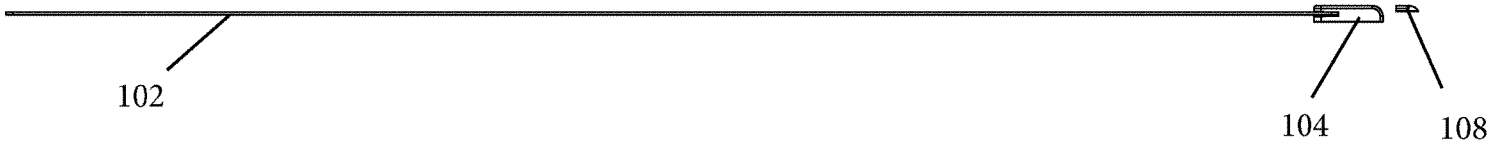
FIG. 3 is a right side elevational view of the firearm cleaning mat of FIG. 1.
Figure 4:
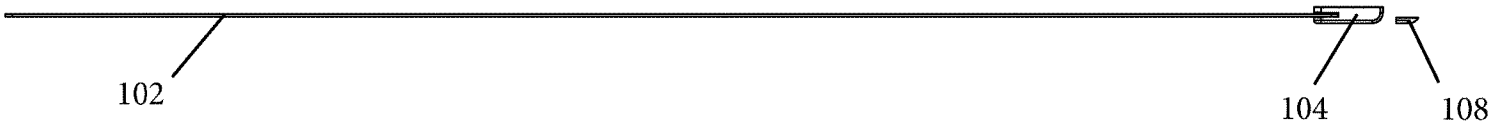
FIG. 4 is a left side elevational view of the firearm cleaning mat of FIG. 1.
Figure 6:
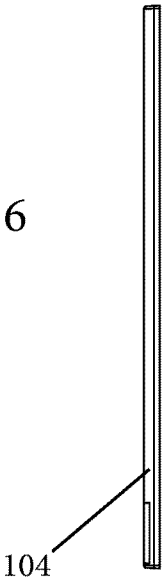
FIG. 6 is a back elevational view of the firearm cleaning mat of FIG. 1.
Figure 5:
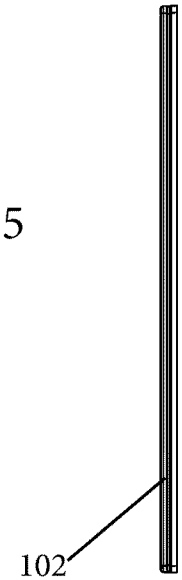
FIG. 5 is a front elevational view of the firearm cleaning mat of FIG. 1.
Figure 7:
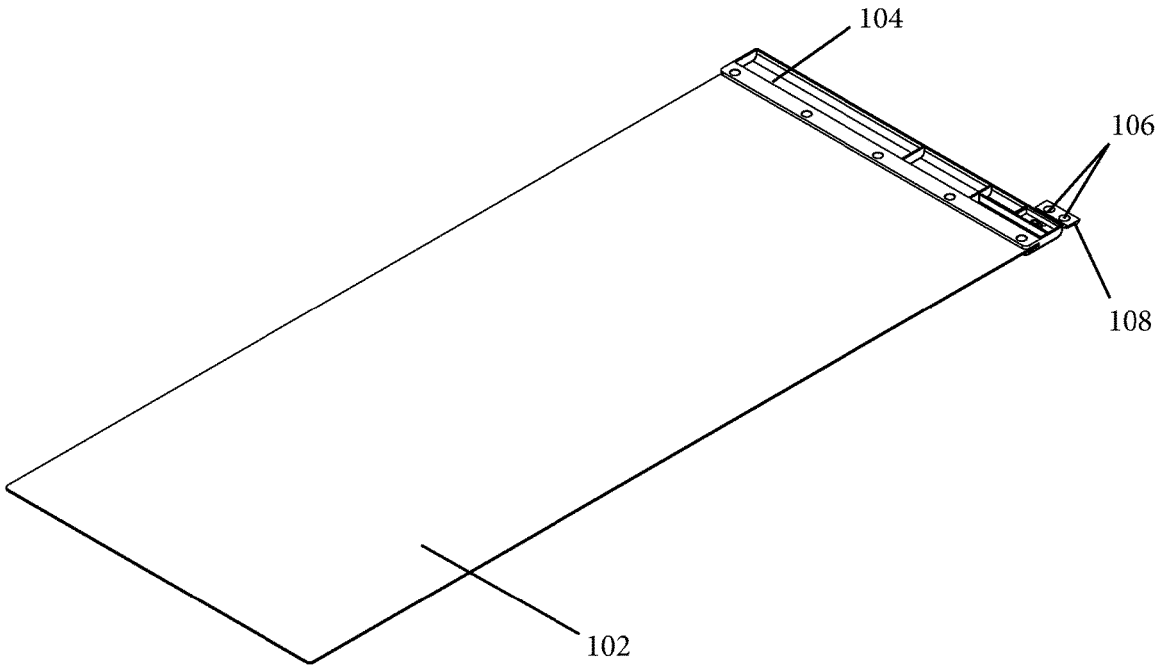
FIG. 7 is a top perspective view of the firearm cleaning mat of FIG. 1.
Figure 8:
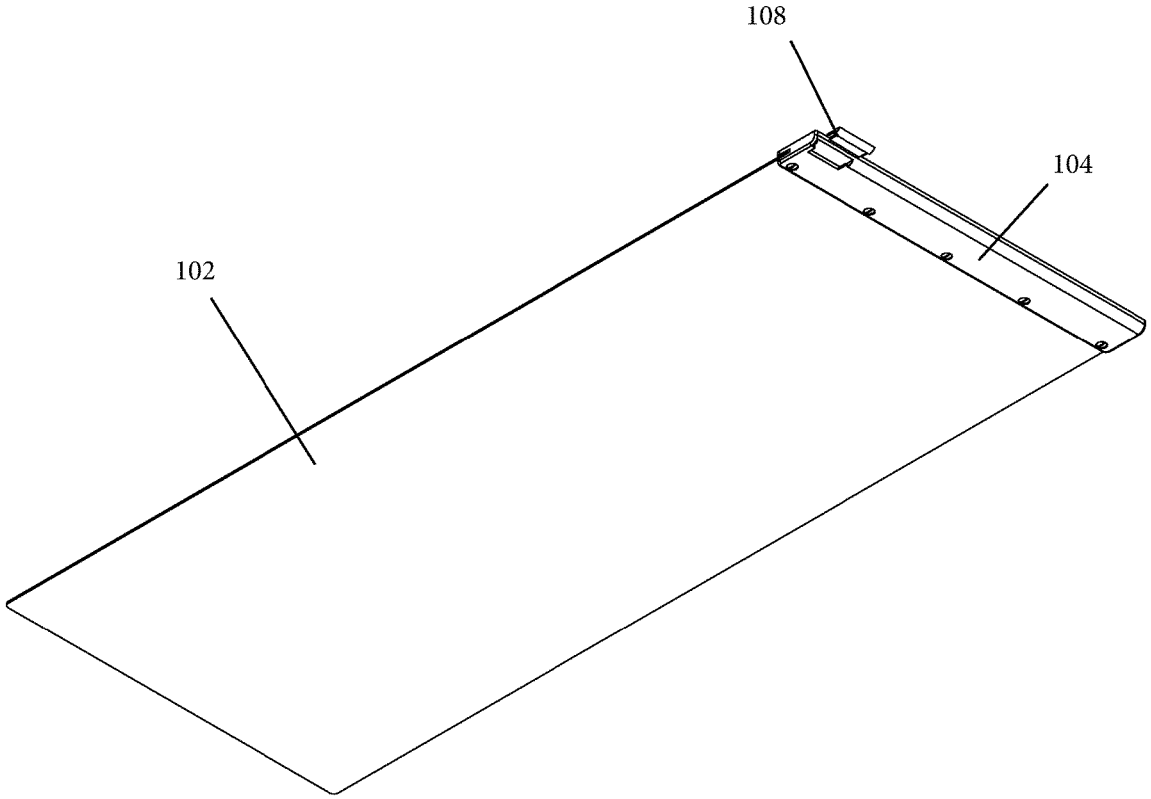
FIG. 8 is a bottom perspective view of the firearm cleaning mat of FIG. 1.
Figure 9:
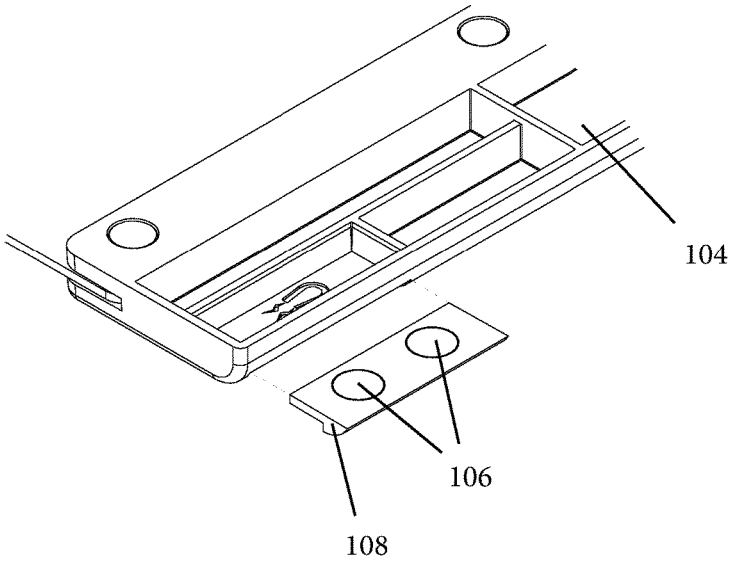
FIG. 9 is a top perspective view of a portion of a small parts storage tray that includes a drawer containing magnets.
Figure 10:
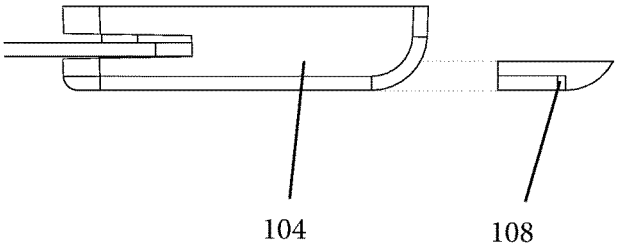
FIG. 10 is a left side view of the small parts storage tray illustrating how the drawer containing the magnets fits into the small parts storage tray.
Figure 11:
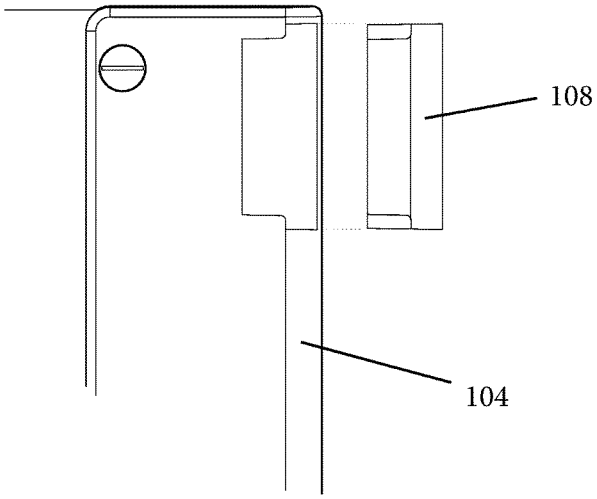
FIG. 11 is a bottom view of a portion of the small parts storage tray illustrating how the drawer containing the magnets fits into the small parts storage tray.

FIGS. 1-8 illustrate various views of an example of a firearm cleaning mat according to the present disclosure. FIG. 1 is a top plan view. FIG. 2 is a bottom plan view. FIG. 3 is a right side elevational view. FIG. 4 is a left side elevational view. FIG. 5 is a front elevational view. FIG. 6 is a back elevational view. FIG. 7 is a top perspective view. FIG. 8 is a bottom perspective view. FIGS. 9-11 illustrate how a magnet-containing drawer fits into a small parts storage tray of the firearm cleaning mat.

Generally, the firearm cleaning mat is relatively thin and flat. In a preferred embodiment, as illustrated in FIG. 1, the firearm cleaning mat is comprised of a flexible mat 102, a small parts storage tray 104, and a magnet 106 in a drawer 108. The flexible mat 102 is roughly rectangular, but can take any variety of shapes such as an oval, circle, triangle, square, or other polygon. The small parts storage tray 104 can be located on the top or bottom of the firearm cleaning mat. However, the small parts storage tray 104 is preferably located on one end of the firearm cleaning mat and, in a preferred embodiment, is also roughly rectangular.

The flexible mat 102 can be made of any flexible material. For example, it can be made of a padded rubber material with fabric. In some embodiments, the flexible mat 102 is made of neoprene with a coated fabric adhered to the top surface. The fabric on the top surface of the flexible mat 102 is, in some embodiments, an oil and/or solvent repellent. Further, the fabric may be water resistant. The flexible mat 102 can also be padded to protect the firearm and its components from scratches or dents if the firearm or its components are dropped onto or aggressively handled on the firearm cleaning mat. Additionally, because firearms are usually cleaned with solvents, the flexible mat 102 can protect the surface it is placed on, such as a tabletop, from exposure to oils, cleaning solvents, and damage from the firearm components.

In some embodiments, the flexible mat 102 can provide step-by-step instructions to disassemble a firearm for cleaning. For example, the step-by-step instructions may be illustrated on the surface of the flexible mat 102. The illustrations may include images of specific firearm components that need to be removed from each other. They may also indicate in what order those components should be removed in, and they may include writing in addition to the illustrations. In some embodiments, the writing can be printed firearm information. In other embodiments, the writing can be a guide with steps that more specifically explains how the components can be removed from each other to disassemble the firearm.

The small parts storage tray 104 can have several compartments, which can help a user keep the firearm's small parts separate from each other or help keep them in specific groupings. In some embodiments, the compartments can be uniform in size. However, in a preferred embodiment, the compartments are of various sizes, as illustrated in FIGS. 1 and 7. For example, there may be a longer or larger compartment for the largest small parts, such as a rod, and there may be one or more small compartments that help a user keep the smallest parts, such as small screws or pins, together or in specific groupings.

In one embodiment, the small parts storage tray 104 has five compartments, wherein a first and a second compartment have the same width as the tray itself, a third, fourth, and fifth compartment are approximately half the width as the tray, the first compartment is approximately half the length of the tray, the second and third compartments are approximately one quarter the length of the tray, and the fourth and fifth compartments are approximately one eighth the length of the tray, as illustrated in FIG. 1. The outside row of compartments can have exterior radiused corners to make the removal of small parts from the firearm easier.

The small parts storage tray 104 can be made of any rigid material such as, but not limited to, plastic, aluminum, steel, wood, carbon fiber, other materials, or combinations of these. In some embodiments, the small parts storage tray 104 can be injection molded using ABS resin.

In a preferred embodiment, the small parts storage tray 104, or a portion of it, can be magnetic so that small, metal pieces from the firearm that are placed into the small parts storage tray 104 remain contained within the small parts storage tray 104 even if the flexible mat 102 or small parts storage tray 104 are bumped or shifted. The small, metal pieces from the firearm can be retained in the small parts storage tray due to magnetic attraction between the small, metal pieces and magnet 106. For example, a magnet 106 may be embedded within or attached to the surface of the metal small parts storage tray 104. More specifically, the magnet 106 may sit inside the small parts storage tray 104 within one of the compartments, it may be embedded and encompassed within the small parts storage tray 104 so that it is not visible, or it may be embedded in the small parts storage tray 104 with one or more of its faces still exposed (for example, the magnet 106 is embedded on the underside of the small parts storage tray 104). In a preferred embodiment, the magnet 104 fits inside a drawer 108 that slides into, and attaches to, the small parts storage tray 104. In some embodiments, the small parts storage tray 104, in its entirety, is magnetic. In other embodiments, the magnet 106 may only affect a portion of the small parts storage tray 104 so that only that designated portion is magnetic. The magnet 106 may be any type of magnet, such as a vinyl magnet with an adhesive backing that is placed in one of the compartments of the small parts storage tray 104. In some embodiments, the magnet 106 is a neodymium magnet. In a preferred embodiment, the magnet 106 is a rare earth magnet, and the small parts storage tray 104 includes two rare earth magnets stored in a drawer 108 below a compartment of the small parts storage tray 104. More specifically, as illustrated in FIGS. 9-11, the magnets 106 are embedded in a drawer 108 that slides into the bottom of the small parts storage tray 104. The drawer 108 can be permanently affixed to the small parts storage tray 104 or it can be removable. In this regard, the magnets 106 are not visible to a user.

As illustrated in FIGS. 3 and 4, the small parts storage tray 104 can attach to the flexible mat 102 by clamping the front and back side of the flexible mat 102 between the top and bottom of the small parts storage tray 104 and using fasteners, such as, but not limited to, bushing fasteners, rivets, glue, tape, an insert-mold, screws, or other general fasteners to keep the small parts storage tray 104 in place. In a preferred embodiment, the small parts storage tray 104 secures to the flexible mat 102 using removable, threaded, bushing fasteners. For example, the small parts storage tray 104 may use five removable, threaded, bushing fasteners. In some embodiments, the small parts storage tray 104 can be fixed in place. However, in other embodiments, the small parts storage tray 104 is removable and can be secured along any edge of the flexible mat 102.

The firearm cleaning mat can have one or more small parts storage trays 104. In some embodiments, the firearm cleaning mat has one small parts storage tray 104 located on one end of a flexible mat 102. More specifically, the small parts storage tray 104 may be located on a short end of a rectangular flexible mat 102, as illustrated in FIGS. 1-4 and 7-8, or on a long end of a rectangular flexible mat 102. In other embodiments, the firearm cleaning mat may have a plurality of small parts storage trays 104 along one or more edges of the flexible mat 102. For example, the firearm cleaning mat may have two small parts storage trays 104 along a long end of a rectangular flexible mat 102, thereby operating as one long, small parts storage tray 104. The two small parts storage trays 104 may be removable, thus enabling a user to have two, shorter small parts storage trays 104 that have space between them on one side of the flexible mat 104 or that are on two edges of the flexible mat 104. Any combination of small parts storage trays 104 and locations along the sides of the flexible mat 104 is possible. However, in a preferred embodiment, the small parts storage tray 104 can be as long as, or slightly longer than, the side of the flexible mat 102 to which it is attached, as illustrated in FIGS. 1-4 and 7-8.

The various embodiments described above are provided by way of illustration only and should not be construed to limit the claims attached hereto. Those skilled in the art will readily recognize various modifications and changes that may be made without following the example embodiments and applications illustrated and described herein and without departing from the true spirit and scope of the following claims.

What is claimed is:

1. A gun cleaning mat comprising:

a flat, padded mat; and a storage tray attached to the mat comprising a magnet embedded within the storage tray, wherein the magnet is configured to retain metal pieces of the gun being cleaned due to magnetic attraction of the metal pieces to the magnet.

2. The gun cleaning mat of claim 1, wherein the mat further comprises a coated fabric adhered to a top surface of the mat.

3. The gun cleaning mat of claim 2, wherein the coated fabric comprises a water repellent and oil resistant surface.

4. The gun cleaning mat of claim 2, wherein the top surface of the mat comprises printed firearm information.

5. The gun cleaning mat of claim 1, wherein the storage tray attaches to the mat using fasteners.

6. The gun cleaning mat of claim 1, wherein the storage tray attaches to the mat using fasteners that are removable, threaded, bushing fasteners.

7. The gun cleaning mat of claim 1, wherein the mat is rectangular.

8. The gun cleaning mat of claim 1, further comprised of a magnet embedded in a drawer, wherein the drawer fits in, and is affixed to, the storage tray.

9. The gun cleaning mat of claim 1, wherein the storage tray is configured to hold small parts of a firearm.

10. The gun cleaning mat of claim 1, wherein the storage tray is configured to hold components of a firearm.

11. The gun cleaning mat of claim 10, wherein the components of a firearm comprise rods, screws, pins, or a combination thereof.

12. A gun cleaning mat comprising:

a flat, rectangular, padded mat;

a storage tray attached to an end of the mat via removable, threaded, bushing fasteners; and a magnet embedded in a drawer, wherein the drawer fits in, and is affixed to, the storage tray, wherein the magnet is configured to retain metal pieces of the gun being cleaned due to magnetic attraction of the metal pieces to the magnet.

13. The gun cleaning mat of claim 12, wherein the mat is further made of a coated fabric adhered to a top surface of the mat.

14. A gun cleaning mat comprising:

a flat, padded mat; and a storage tray attached to the mat;

wherein at least a portion of the storage tray is magnetic and configured to retain metal pieces of the gun being cleaned due to magnetic attraction of the metal pieces to the magnet.

15. The gun cleaning mat of claim 14, wherein a magnet is embedded within or attached to a surface of the storage tray.

16. The gun cleaning tray of claim 14, wherein a magnet is embedded on an underside of the storage tray.

* * * * *